US007233749B2

(12) United States Patent
Yoshizuka et al.

(10) Patent No.: US 7,233,749 B2
(45) Date of Patent: Jun. 19, 2007

(54) IMAGE FORMING DEVICE FOR PERFORMING CALIBRATION BY PATCH PATTERN

(75) Inventors: Ken Yoshizuka, Nagano-ken (JP); Keiichi Taguchi, Nagano-ken (JP); Hiroshi Tanaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 11/124,404

(22) Filed: May 9, 2005

(65) Prior Publication Data

US 2005/0281575 A1 Dec. 22, 2005

(30) Foreign Application Priority Data

May 11, 2004 (JP) ..... 2004-141193

(51) Int. Cl.
*G03G 15/00* (2006.01)

(52) U.S. Cl. ..... 399/49; 399/72; 399/178; 399/226

(58) Field of Classification Search ..... 399/41, 399/49, 39, 134, 72, 226, 227, 178
See application file for complete search history.

(56) References Cited

U.S. PATENT DOCUMENTS 5,016,050 A * 5/1991 Roehrs et al. ..... 399/50
5,729,786 A * 3/1998 Yamada et al. ..... 399/42
5,903,796 A * 5/1999 Budnik et al. ..... 399/26
6,768,878 B2 * 7/2004 Komatsu et al. ..... 399/49

FOREIGN PATENT DOCUMENTS

JP 2002-236405 A 8/2002
JP 2002236405 A * 8/2002
JP 2002-251047 A 9/2002
JP 2002-351190 A 12/2002
JP 2003-316106 A 11/2003
JP 2003316106 A * 11/2003

* cited by examiner

*Primary Examiner*—David M. Gray
*Assistant Examiner*—Geoffrey T Evans
(74) *Attorney, Agent, or Firm*—Sughrue Mion, PLLC

(57) ABSTRACT

An image forming device, has an image carrier on which a latent image is formed, and a development device to which a plurality of development units for containing developer with the same color are detachably installed, and development is performed by attaching the developer of the development unit on the latent image of the image carrier. And the image forming device further has calibration control unit for forming the latent image of a predetermined patch pattern on the image carrier, developing the image by the developer of the development unit, detecting the developed patch pattern and deciding control parameters, and the calibration control unit performs calibration by only apart of the development units or by one development unit out of the plurality of development units.

6 Claims, 8 Drawing Sheets

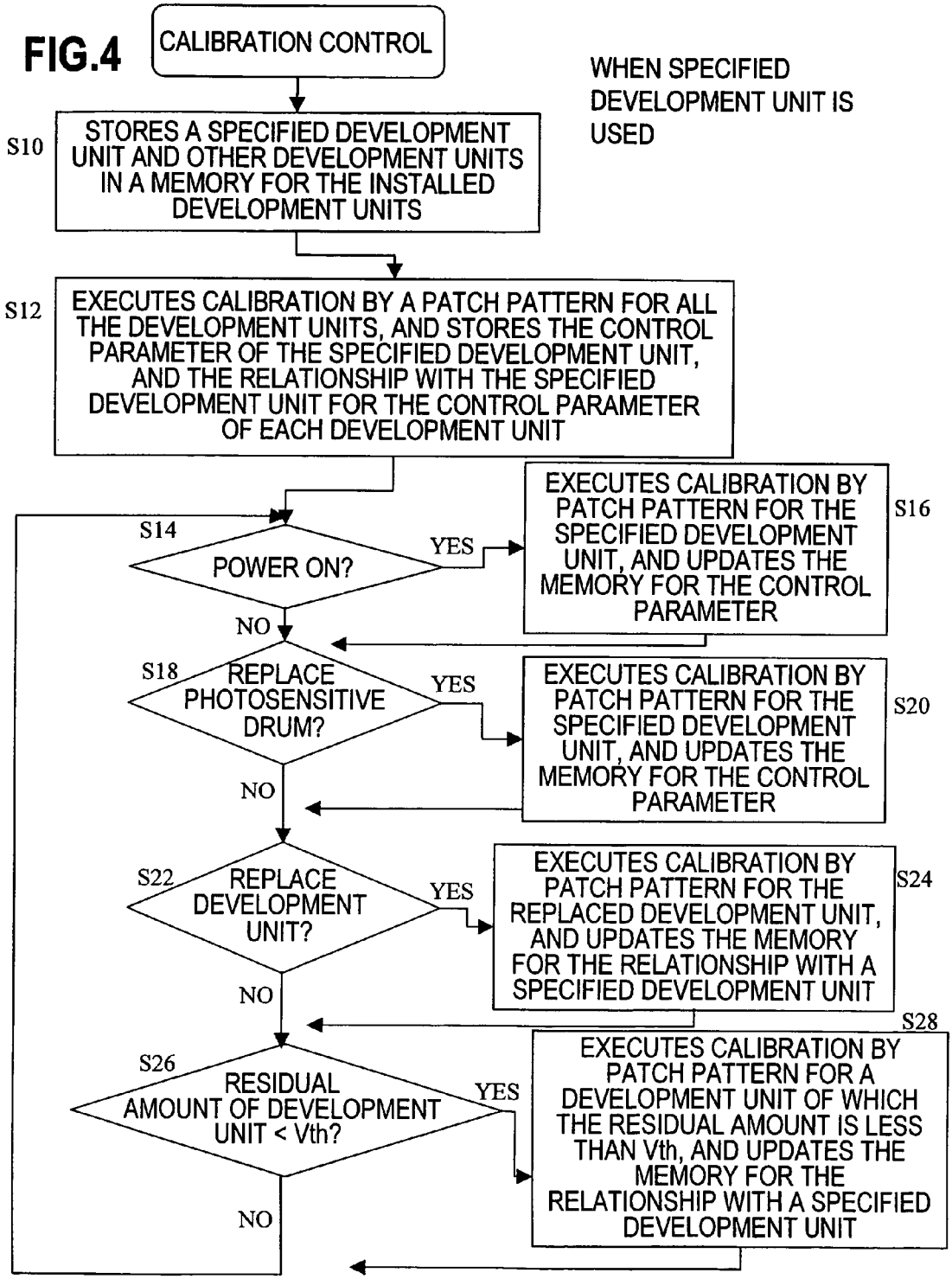
FIG.4
CALIBRATION CONTROL
WHEN SPECIFIED DEVELOPMENT UNIT IS USED
S10
STORES A SPECIFIED DEVELOPMENT UNIT AND OTHER DEVELOPMENT UNITS IN A MEMORY FOR THE INSTALLED DEVELOPMENT UNITS
S12
EXECUTES CALIBRATION BY A PATCH PATTERN FOR ALL THE DEVELOPMENT UNITS, AND STORES THE CONTROL PARAMETER OF THE SPECIFIED DEVELOPMENT UNIT, AND THE RELATIONSHIP WITH THE SPECIFIED DEVELOPMENT UNIT FOR THE CONTROL PARAMETER OF EACH DEVELOPMENT UNIT
S14
POWER ON?
YES
EXECUTES CALIBRATION BY PATCH PATTERN FOR THE SPECIFIED DEVELOPMENT UNIT, AND UPDATES THE MEMORY FOR THE CONTROL PARAMETER
S16
NO
S18
REPLACE PHOTOSENSITIVE DRUM?
YES
EXECUTES CALIBRATION BY PATCH PATTERN FOR THE SPECIFIED DEVELOPMENT UNIT, AND UPDATES THE MEMORY FOR THE CONTROL PARAMETER
S20
NO
S22
REPLACE DEVELOPMENT UNIT?
YES
EXECUTES CALIBRATION BY PATCH PATTERN FOR THE REPLACED DEVELOPMENT UNIT, AND UPDATES THE MEMORY FOR THE RELATIONSHIP WITH A SPECIFIED DEVELOPMENT UNIT
S24
NO
S26
RESIDUAL AMOUNT OF DEVELOPMENT UNIT < Vth?
YES
EXECUTES CALIBRATION BY PATCH PATTERN FOR A DEVELOPMENT UNIT OF WHICH THE RESIDUAL AMOUNT IS LESS THAN Vth, AND UPDATES THE MEMORY FOR THE RELATIONSHIP WITH A SPECIFIED DEVELOPMENT UNIT
S28
NO

FIG.5

| DEVELOPMENT UNIT | CONTROL PARAMETER |
|---|---|
| A (SPECIFIED) | CPA |
| B | CPA+dB (=CPB) |
| C | CPA+dC (=CPC) |
| D | CPA+dD (=CPD) |

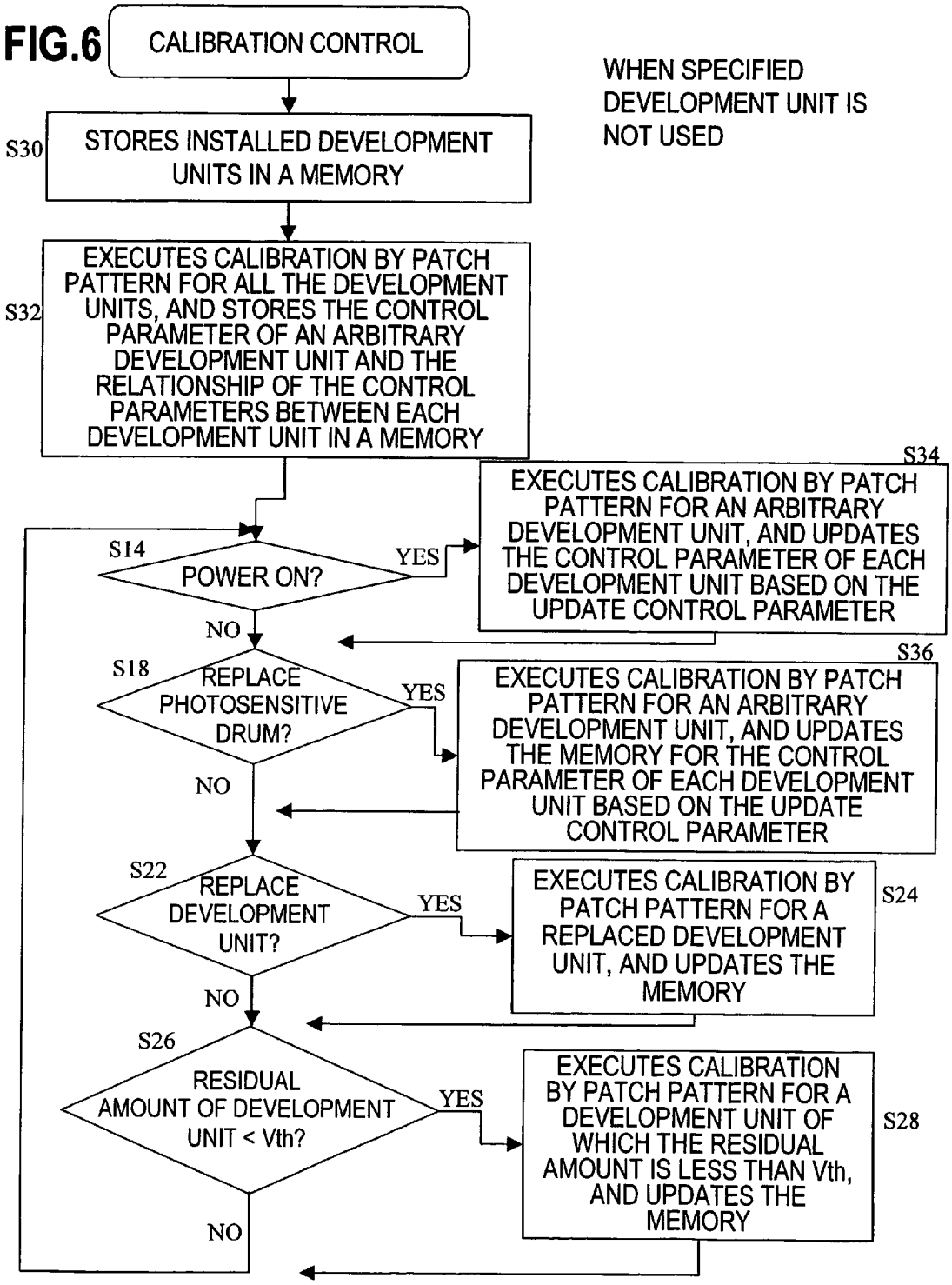
FIG.6
CALIBRATION CONTROL
WHEN SPECIFIED DEVELOPMENT UNIT IS NOT USED
S30
STORES INSTALLED DEVELOPMENT UNITS IN A MEMORY
S32
EXECUTES CALIBRATION BY PATCH PATTERN FOR ALL THE DEVELOPMENT UNITS, AND STORES THE CONTROL PARAMETER OF AN ARBITRARY DEVELOPMENT UNIT AND THE RELATIONSHIP OF THE CONTROL PARAMETERS BETWEEN EACH DEVELOPMENT UNIT IN A MEMORY
S14
POWER ON?
YES
S34
EXECUTES CALIBRATION BY PATCH PATTERN FOR AN ARBITRARY DEVELOPMENT UNIT, AND UPDATES THE CONTROL PARAMETER OF EACH DEVELOPMENT UNIT BASED ON THE UPDATE CONTROL PARAMETER
NO
S18
REPLACE PHOTOSENSITIVE DRUM?
YES
S36
EXECUTES CALIBRATION BY PATCH PATTERN FOR AN ARBITRARY DEVELOPMENT UNIT, AND UPDATES THE MEMORY FOR THE CONTROL PARAMETER OF EACH DEVELOPMENT UNIT BASED ON THE UPDATE CONTROL PARAMETER
NO
S22
REPLACE DEVELOPMENT UNIT?
YES
EXECUTES CALIBRATION BY PATCH PATTERN FOR A REPLACED DEVELOPMENT UNIT, AND UPDATES THE MEMORY
S24
NO
S26
RESIDUAL AMOUNT OF DEVELOPMENT UNIT < Vth?
YES
EXECUTES CALIBRATION BY PATCH PATTERN FOR A DEVELOPMENT UNIT OF WHICH THE RESIDUAL AMOUNT IS LESS THAN Vth, AND UPDATES THE MEMORY
S28
NO

FIG.8

| DEVELOPMENT UNIT | CONTROL PARAMETER |
|---|---|
| A (SPECIFIED) | CPA |
| B | CPB=CPA |
| C | CPC=CPA |
| D | CPD=CPA |

IMAGE FORMING DEVICE FOR PERFORMING CALIBRATION BY PATCH PATTERN

BACKGROUND OF THE INVENTION

1. Field of the Invention

The present invention relates to an image forming device for forming images using electronic printing technology, and more particularly to an image forming device which has a plurality of development units containing a same color developer and can simplify calibration by patch patterns.

2. Description of the Related Art

An image forming device for forming images using electro-photographic technology is installed in a printer, facsimile and copier, and is comprised of an image carrier (photosensitive drum) on which an electrostatic latent image is formed according to the image data, a charge unit for charging the outer face of the image carrier, an exposure unit for exposing the charged outer face of the image carrier according to the image data and forming an electrostatic latent image, a development device for developing the electrostatic latent image of the image carrier into a toner image by supplying toner, which is the developer, to the image carrier, and a transfer unit for transferring the toner image to the transfer target medium. The development device detachably holds a plurality of development units which contain color toners and moves an appropriate development unit closer to the image carrier according to the development timing. For this, the development device has a development rotary of which rotation is controlled. For color printing, the development units of a plurality of color toners, such as four colors (yellow Y, magenta M, cyan C and black K) are installed in the development rotary, and these development units are sequentially moved closer to the image carrier, and each color is developed.

On the other hand, an image forming device, dedicated to monochrome printing by simultaneously installing a plurality of development units with the same color, such as black, in the development rotary of the development device, has been proposed. Examples are Japanese Patent Application Laid-Open No. 2002-351190 (Dec. 4, 2002) and Japanese Patent Application Laid-open No. 2003-316106 (Nov. 6, 2003). Since in this image forming device dedicated to monochrome printing, a plurality of black development units can be installed, so the replacement frequency of development units can be decreased by sequentially using the plurality of development units even if a large volume of monochrome printing is performed.

In the case of an image forming device using electro-photographic technology, the image carrier is charged to a predetermined bias potential, a latent image is formed by irradiating an exposure beam with a predetermined intensity, and toner is attached from the development unit by the bias voltage difference between the development unit and image carrier. Therefore the toner attachment status differs depending on such control parameters as the bias voltage and the exposure intensity between the development unit and image carrier. Even if the same control parameters are used, the toner attachment status differs by changes in the external environment and the replacement of the development unit. Therefore calibration is normally performed where a predetermined patch pattern is generated on the image carrier by the toner, and optimum control parameters are determined according to the optical density of the patch pattern.

Optimum control parameters may differ depending on the positional relationship between the development unit and the image carrier, and the status and type of the developer in the development unit, and in the case of a color image forming device which superimposes images of a plurality of colors of developer, calibration by a patch pattern is performed for all the development units. This is because in the case of color images, if the optical density of each color disperses, the mixed color thereof itself becomes different.

SUMMARY OF THE INVENTION

However this calibration step is executed in the initial step of the image forming device or when power is turned ON or when the image carrier is replaced, so if the calibration step is executed for all the development units each time, the time required for the calibration step becomes long which makes the user wait a long time, and secondly a large amount of developer is wasted in forming a patch pattern. Particularly in the case of the image forming device dedicated to monochrome printing, performing calibration for all plurality of development units with the same color is not always necessary.

With the foregoing in view, it is an object of the present invention to provide an image forming device of which the calibration step by a patch pattern is shortened.

It is another object of the present invention to provide an image forming device of which the calibration step by a patch pattern is simplified.

To achieve the above objects, a first aspect of the present invention is an image forming device, comprising an image carrier on which a latent image is formed, and a development device to which a plurality of development units for containing developer with the same color are detachably installed, and development is performed by attaching the developer of the development unit on the latent image of the image carrier. And the image forming device further comprises calibration control unit for forming the latent image of a predetermined patch pattern on the image carrier, developing the image by the developer of the development unit, detecting the developed patch pattern and deciding control parameters, and the calibration control unit performs calibration by only a part of the development units or by one development unit out of the plurality of development units.

In the above aspect of the present invention, according to a preferred embodiment, the calibration unit performs calibration by only one arbitrary unit out of the plurality of development units. According to another preferred embodiment, the calibration unit performs calibration by only one specific development unit out of the plurality of development units.

In the above aspect of the present invention, according to a preferred embodiment, the relationship of control parameters for the plurality of development units are stored in a memory, and the control parameters for each development unit are determined based on the result of calibration by a part of the development units out of the plurality of development units and the relationship of the control parameters stored in the memory.

According to another preferred embodiment, control parameter based on the calibration result by a part of the development units is applied to other development units.

To achieve the above objects, a second aspect of the present invention is an image forming device, comprising an image carrier on which a latent image is formed, a development device to which a plurality of development units for containing developer with the same color are detachably installed, and control unit for forming a latent image on the image carrier based on the control parameters corresponding to the development unit and developing the latent image by attaching the developer of the development unit thereto, wherein the control unit comprises calibration control unit for forming a latent image of a predetermined path pattern on the image carrier at a predetermined calibration timing, developing the latent image by the developer of the development unit, detecting the developed patch pattern, and deciding control parameters, and the calibration control unit performs calibration by only a part of the development units out of the plurality of development units at the predetermined calibration timing.

BRIEF DESCRIPTION OF THE DRAWINGS

FIG. 4 is a flow chart depicting the calibration control according to the first embodiment;

FIG. 5 is a table showing an example of data to be stored in the non-volatile memory 116*a* by the initialization processing;

FIG. 6 is a flow chart depicting the calibration control according to the second embodiment;

FIG. 8 is a table showing an example of data to be stored in the non-volatile memory 116*a* by the initialization processing according to the third embodiment.

DESCRIPTION OF THE PREFERRED EMBODIMENTS

Embodiments of the present invention will now be described with reference to the drawings. The technical scope of the present invention, however, is not limited to these embodiments, but shall include matters written in the claims and equivalents thereof.

Figure 1:
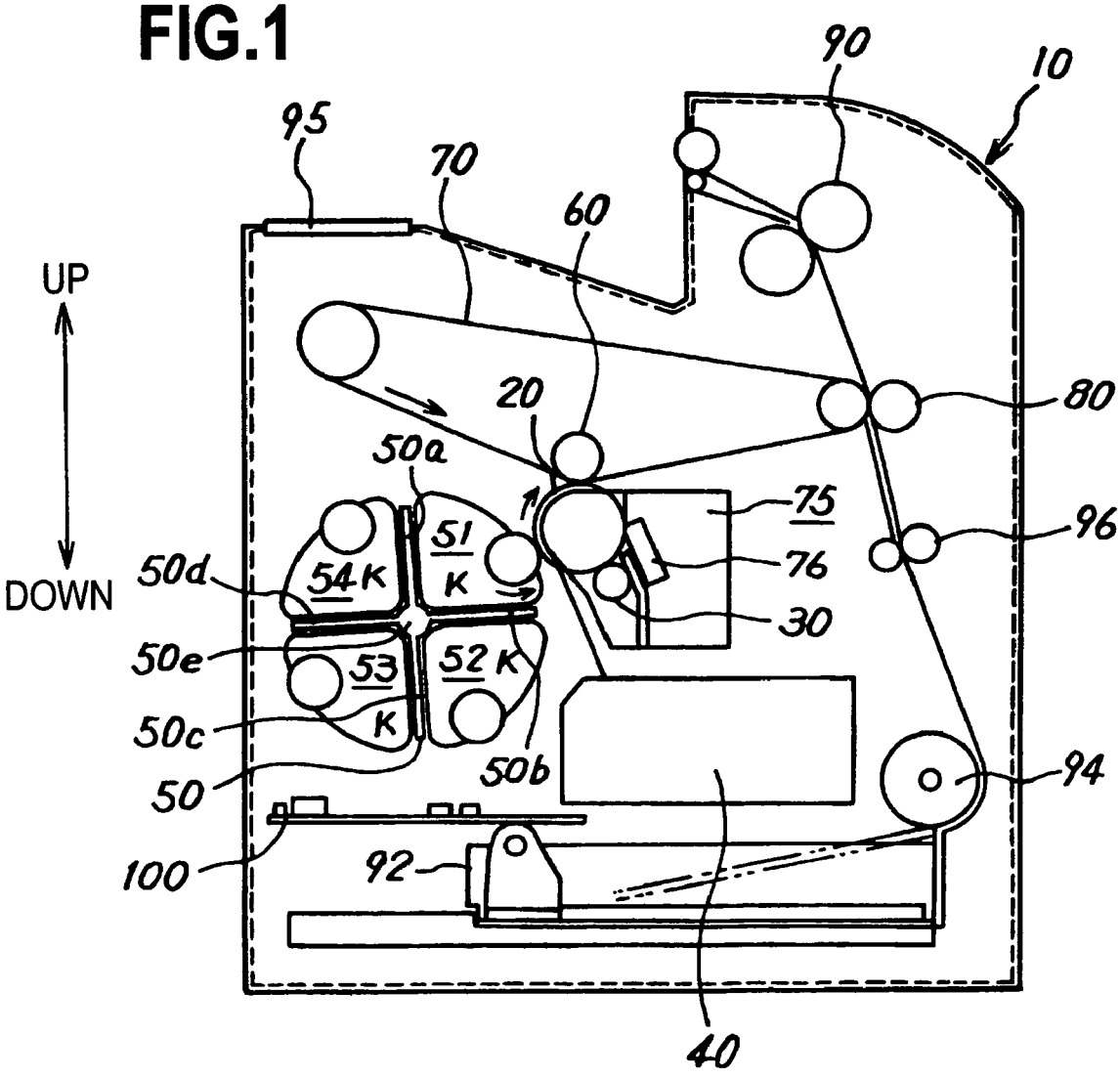
FIG. 1 is a diagram depicting a major configuration of the image forming device according to the present embodiment.

FIG. 1 is a diagram depicting a major configuration of the image forming device according to the present embodiment. In the present embodiment, the image forming device will be described using the laser beam printer 10 as an example. The printer 10 in FIG. 1 shows the configuration in monochrome printing mode.

The printer 10 comprises a charge unit 30, exposure unit 40, development device 50, primary transfer unit 60, intermediate transfer body 70, and cleaning unit 75, along the rotation direction of a photosensitive drum 20 which is an image carrier on which a latent image is held. The printer 10 further comprises a secondary transfer unit 80, fixing unit 90, display unit 95 for outputting various information to the user, and control unit 100 for controlling these units.

The photosensitive drum 20 comprises a cylindrical conductive base material and a photosensitive layer formed on the outer surface thereof, and can rotate around the central axis in a clockwise direction as shown by the arrow mark. The charge unit 30 uniformly charges the outer surface of the photosensitive drum 20, and the exposure unit 40 irradiates a beam of the internal light source, such as a laser and an LED array, onto the charged photosensitive drum 20, and forms a latent image by static electricity. The beam irradiation of the exposure unit 40 is controlled by the drive signals modulated based on the image information which is input from the host computer.

The development device 50 comprises installation sections 50*a*–50*d* where the development units 51–54 for containing toner, that is developer, can be detachably installed, and the development device 50 is a development rotary which can rotate around the central axis 50*e*. By moving the necessary development units 51–54 close to the photosensitive drum 20 by rotating the development device 50, and by supplying the charged developer to the photosensitive drum 20 by bias voltage between the development unit and photosensitive drum, a latent image is developed into an image by the developer.

In the example in FIG. 1, the development units 51–54 for containing the developer of black K is installed in all the installation sections 50*a*–50*d* of the development device 50, so as to be set in monochrome printing mode. In the monochrome printing process, development is performed using the developer of one of the development units. If development units containing the developer of black K, cyan C, magenta M and yellow Y are installed respectively in the installation sections 50*a*–50*d* of the development device 50, color printing mode is set. In the color printing process, a latent image is formed on the photosensitive drum 20 in the sequence of CMYK, and development by the respective developer is performed. Therefore the development device 50 rotates in a counterclockwise direction and moves the development unit with an appropriate color to the photosensitive drum 20 for each latent image formation and development process of each color, and performs development sequentially.

The primary transfer unit 60 transfers the toner image formed on the photosensitive drum 20 to the intermediate transfer body 70. The intermediate transfer body 70 is an endless belt, where an aluminum deposition layer is formed on the surface of the PET film and a semiconductive coating is formed on this surface, for example, and is driven to rotate at a same peripheral velocity as the photosensitive drum 20. In the color printing mode, each image of CMYK is transferred respectively and overlaid onto the intermediate transfer body 70, and in the monochrome printing mode, a single color image is transferred to the intermediate transfer body 70. And the secondary transfer unit 80 transfers the toner image formed on the intermediate transfer body 70 to a printing medium, such as paper, the fixing unit 90 fixes the toner image transferred on the printing medium to the medium to form a permanent image, and the printing medium is ejected outside the printer.

The cleaning unit 75, which is installed between the primary transfer unit 60 and the charge unit 30, comprises a cleaning blade 76 which contacts the surface of the photosensitive drum 20, and after the primary transfer the developer (toner) remaining on the photosensitive drum 20 is removed by the cleaning blade 76. The developer to be disposed is stored in the cleaning unit 75 comprising the cleaning blade 76.

Each development unit 51–54 is detachable from the development device 50, and a storage medium for storing the color information and the residual amount information of the developer, such as a non-contact type non-volatile memory, is installed in the development unit so that the printer can recognize the status of the installed development unit. And after the power is turned ON or after the development unit is installed in the development device, the information of the non-volatile memory of the development unit is read. And after development, the residual amount information of the developer is updated in the non-volatile memory of the development unit.

As FIG. 1 shows, when the development units 51–54 for black are installed at all the installation positions of the development device 50, color information is read from the non-volatile memory of the four development units, and the control unit 100 judges this as monochrome printing mode. If the development units for CMYK are installed in the installation positions of the development device 50, color information is read from the non-volatile memory of the four development units, and the control unit 100 judges this as color printing mode. In either printing mode, the developer amount used for printing is determined when printing is executed, and based on this developer amount that was used, the toner residual amount information of the respective development unit is updated and maintained in each non-volatile memory.

Figure 2:
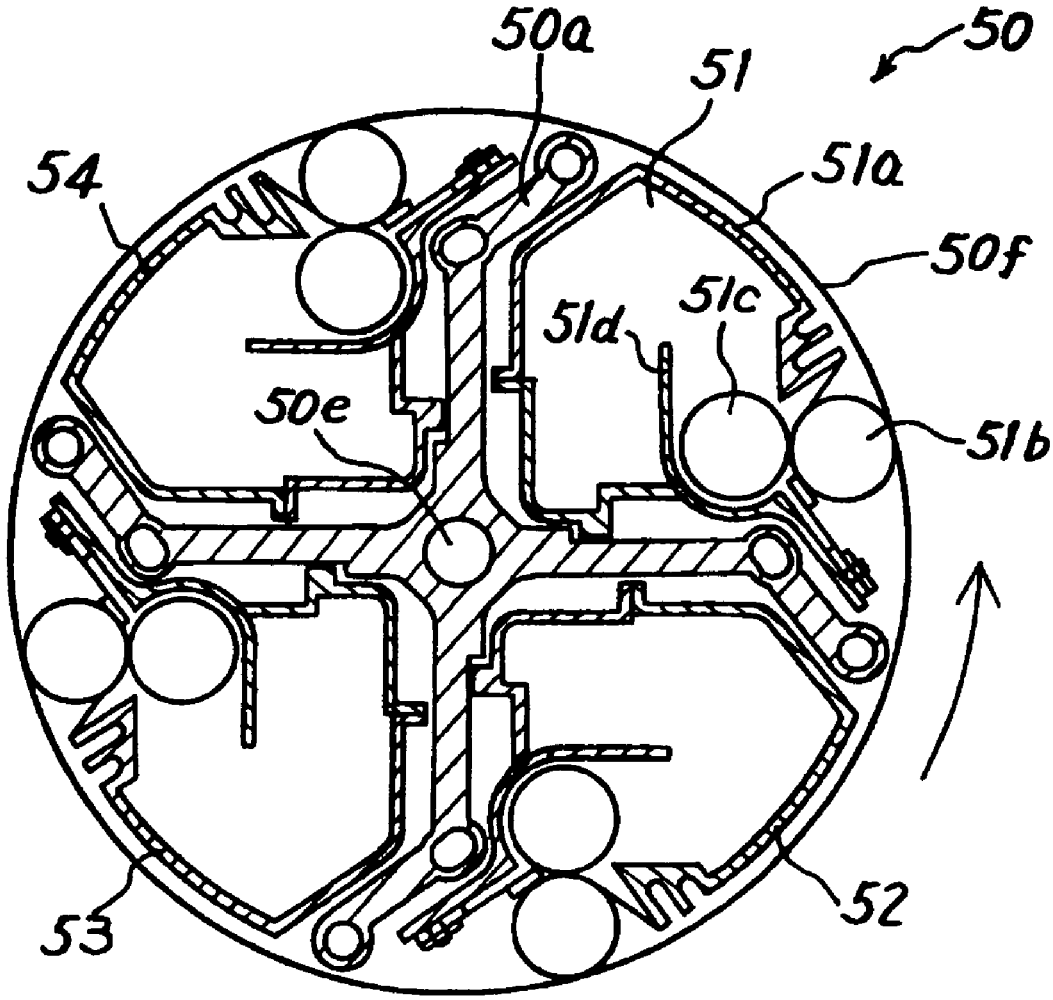
FIG. 2 is a cross-sectional view depicting a detailed structure of the development device 50.

FIG. 2 is a cross-sectional view depicting a detailed structure of the development device 50. In the development device 50, a plurality of development units 51–54 are detachably installed in the space between the housing 50*f* and the installation section 50*a* which rotates around the central axis 50*e*. The plurality of development units all have the same structure, and the development unit 51, for example, comprises a container 51*a*, development roller 51*b*, supply roller 51*c* and partition plate 51*d*. The development roller 51*b* and the supply roller 51*c* are rotatably installed in the container 51*a*, and are rotated by a motor, which is not illustrated, respectively when the development unit becomes close to the photosensitive drum 20. When the supply roller 51*c* is pressed against the development roller 51*b* and rotates, the toner around the area is charged by friction, and the charged toner is supplied to the photosensitive drum 20 via the development roller 51*b*. The partition plate 51*d* is installed so as to surround the supply roller 51*c* and parts the toner storage space in the container 51*a* to the left and right. By installing this partition plate 51*d*, the toner in the space at the supply roller 51*c* side is supplied to the development roller 51*b* side by the pressed rotation between the supply roller 51*c* and the development roller 51*b*. When the development device 50 rotates 90 degrees at a time in the counterclockwise direction, as shown by the arrow mark, and rotates 180 degrees, the development unit 51 comes to the position of the development unit 53, and the toner in the storage space at the supply roller 51*c* side is mixed with the toner in the storage space at the opposite side of the supply roller 51*c* in the area above the partition plate 51*c*, and the mixed toner is stirred and refreshed by the development device 50 further rotating 90 degrees. By the next 90 degree rotation, a part of the stirred and refreshed toner is stored in the storage space at the supply roller 51*c* side. In this way, the toner storage space is divided by the partition plate 51*d*, and the supply roller is installed in one of the toner storage spaces, so the toner charged by friction is stirred and refreshed by the rotation of the development device 50. Therefore it is unnecessary to install a stirring means in the development unit, which decreases the size of the development unit.

Figure 3:
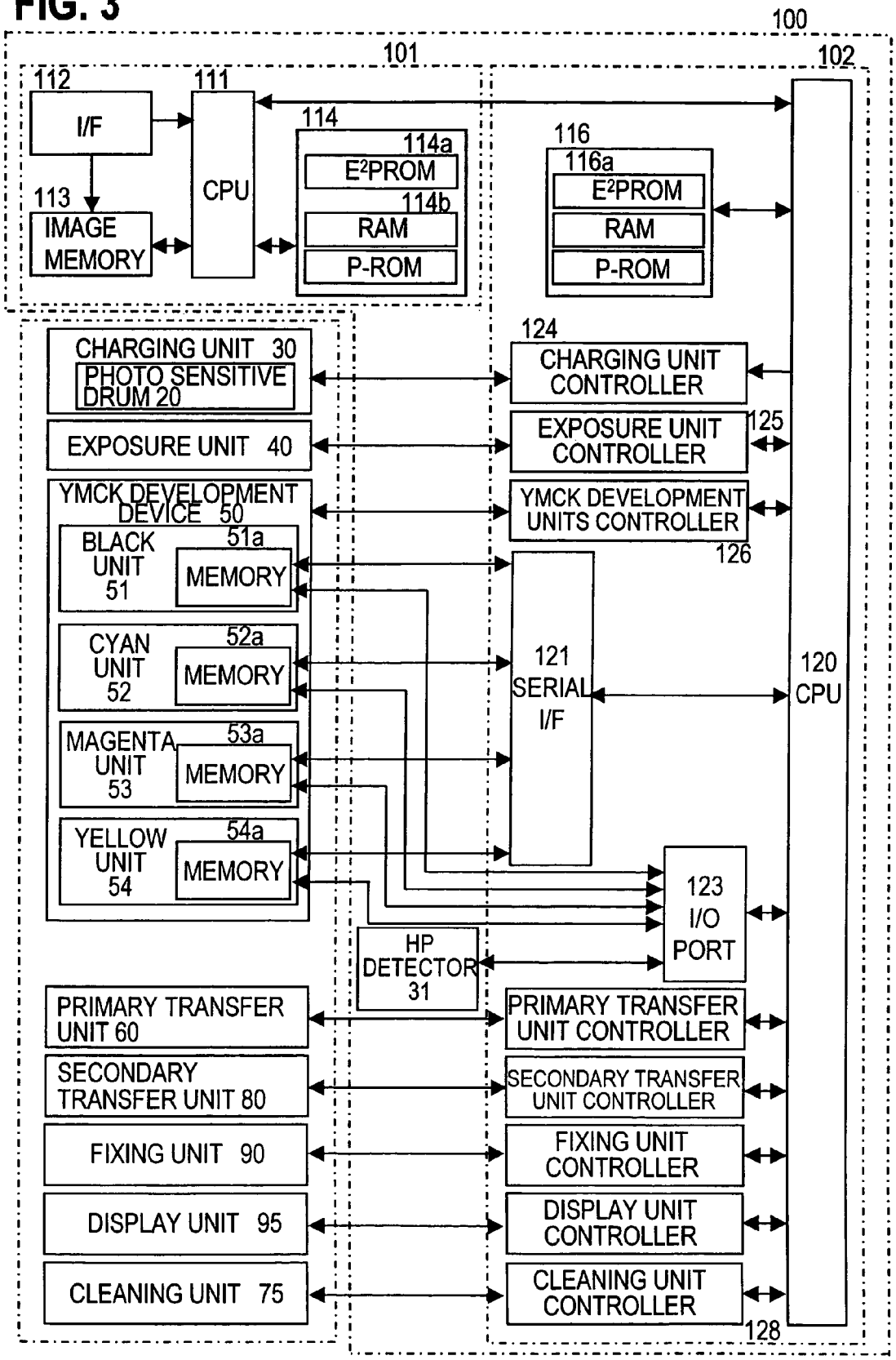
FIG. 3 is a block diagram depicting the control unit 100 according to the present embodiment.

FIG. 3 is a block diagram depicting the control unit 100 according to the present embodiment. The control unit 100 comprises a main controller 101, to which the host computer supplies print job data, for performing predetermined image processing, generating control signals and images signals to the engine, and controlling the display on the display panel 95, and an engine controller 102 for controlling each unit of the printing engine. The main controller 101 further comprises an interface 112 for receiving print job data from the host computer, an image memory 113 for storing the image data in the print job data, a CPU 111 for performing image processing, such as half tone processing, setting display mode, performing automatic judgment, and controlling the display on the display panel, and a memory unit 114 further comprising a non-volatile memory 114*a*, RAM and ROM 114*b*. In the non-volatile memory 114*a*, printing mode information to indicate whether the printer is in color printing mode or monochrome printing mode is stored. The printing mode is judged by the main controller 101 at power ON according to the information from the memory of the development unit installed in the development device, and the determined printing information is written into the non-volatile memory 114*a*.

In addition to the CPU 120, the engine controller 102 further comprises a memory unit 116, serial interface 121, input/output port 123, drive control circuits 124, 125 and 126 for driving the charge unit 30, exposure unit 40 and development device 50 respectively, and drive control circuit group 128 for driving the primary transfer unit 60, secondary transfer unit 80, fixing unit 90, display unit 95, and cleaning unit 75 respectively. The detection section 31 for detecting the home position of the development device 50 is also installed. The engine controller 102, to which control signals for controlling the printing process and image signals for controlling the irradiation of the exposure beam, are supplied from the main controller 101, controls each unit.

The development units 51–54 installed in the development device 50 have development unit side memories 51*a*–54*a* respectively. These memories are non-volatile memories, such as FeRAM and EEPROM, and stores such information as the color information of the developer, residual amount information of the developer, and ID (identification information) of the development unit. If these memories are FeRAM, non-contact access is possible via the serial interface 121, and if they are EEPROM, access is possible by physically connecting the serial interface 121. When power is turned ON or when a development unit is replaced or added, the engine controller 102 accesses these development unit side memories 51*a*–54*a*, and reads such information as the installation of the development unit, color information and identification information. Also in the development process, the residual amount of developer is updated in the memory of the development unit, which finished the development process.

In the non-volatile memory 116*a* in the memory unit 116, information on whether the development units are installed at the four installation positions of the development device, and color information and identification information of the installed development units are stored. Also in the non-volatile memory 116*a*, the control parameters for engine control, control parameters corresponding to each development unit, and color or monochrome printing mode information are stored. In the memory unit 116, the program ROM and RAM are installed, and the program ROM stores the engine control program and calibration control program. By the CPU 120 refreshing the control parameters of the non-volatile memory 116*a* and executing the engine control program, normal printing processing is executed. At a predetermined calibration timing, the CPU 120 executes the calibration control program and performs calibration by a patch pattern using a predetermined development unit, and updates the control parameters according to the calibration result.

In the present embodiment, the control unit 100 performs calibration by the patch pattern to optimize the control parameters in the exposure process and development process. These control parameters include exposure intensity by the exposure unit 40 and bias voltage by the charge unit 30. Based on these control parameters, a latent image is formed on the photosensitive drum 20 and development by toner, which is the developer, is performed. As the exposure intensity and bias voltage increase, the optical density of the developed toner image increases, and as the exposure intensity and bias voltage decrease, the optical density of the toner image decreases. If there is a change in the developer and structure of the development unit, charge history of the developer, characteristics of the photosensitive drum 20 or ambient environment (temperature, humidity), the optical density of the toner image changes, even if the control parameters are the same. Therefore calibration by a patch pattern is performed when a predetermined event is generated, and the optical density of the developed patch pattern is detected and the control parameters are determined based on this result, so that the same optimum optical density is reproduced regardless the status of the environment, photosensitive drum, development unit and charge history. The control parameters are decided corresponding to each development unit, and are stored in the non-volatile memory 116*a* at the main body side.

In order to maintain the optical density of the developed toner image, calibration is performed when (1) power is turned ON, (2) when the photosensitive drum 20, which is the image carrier, is replaced, (3) when the development unit is replaced or newly installed, and (4) when the residual amount of the developer in the development unit becomes a predetermined threshold or less. This is for setting the control parameters matching the operating environment when power is turned ON, for deciding the exposure intensity parameters etc. matching the characteristics of the replaced photosensitive drum when the photosensitive drum 20 is replaced, for deciding the bias voltage parameters etc. matching the development unit when the development unit was replaced or newly installed, and for deciding the bias voltage parameters etc. which are the optimum for a developer with a predetermined charge history when the residual amount of the developer of the development unit becomes a predetermined threshold or less.

The image forming device according to the present embodiment has a color printing mode in which the development units for CMYK are installed, and a monochrome printing mode in which a plurality of development units with the same color, such as black, are installed. In the color printing mode, in addition to the initialization step, calibration is executed using all the development units when (1) power is turned ON and (2) when the photosensitive drum is replaced, and the control parameters of each development unit are decided and stored. Also in the color printing mode, (3) when the development unit is replaced and (4) when the residual amount of toner is decreased, calibration is executed using the replaced development unit or using the development unit of which the residual amount of toner is decreased, and the control parameters of the development unit are determined and updated. This is because in the color printing mode, a plurality of colors of toner must be developed overlapping, so it is preferable to optimize the control parameters of each development unit respectively.

In the monochrome printing mode, the image forming device according to the present embodiment performs calibration by a patch pattern only for a part of the development units, preferably one development unit out of the plurality of development units (1) when power is turned ON and (2) when the photosensitive drum is replaced. In other words, in the monochrome printing mode, printing processing is performed only with one development unit, so it is not extremely necessary to optimize the control parameters of all the development units respectively, as in the case of the color printing mode. For example, the relational values among the control parameters of the four development units are stored, and at a predetermined calibration timing, calibration by only one development unit is executed and the control parameters of this development units are updated, and the control parameters of the other development units are determined based on the relational values between the updated control parameters and the stored control parameters. Assuming that the optimum control parameters are the same for the four development units, the printing processing is executed using common control parameters, and at calibration timing the common control parameters are updated to the optimum values using only one development unit. Then, this common control parameters are employed for all development units. Now the calibration control according to the present embodiment will be described.

FIG. 4 is a flow chart depicting the calibration control according to the first embodiment. In this example, in the monochrome printing mode, a specified one of the four development units is dedicated for calibration, the control parameter relational values of the four development units are detected and stored in a memory in advance, and when power is turned ON and when the photosensitive unit is replaced, calibration is performed only for the specified development unit, and the control parameters of the three development units, other than the specified development unit, are determined by the relational values between the updated control parameters of the specified development unit determined by the calibration and the control parameters stored in the memory. In other words, the control parameters of the four development units are determined and the relational values thereof are determined at the beginning, and when the power is turned ON and when the photosensitive unit is replaced thereafter, calibration is performed not for all the development units but only for the specified development unit, assuming the tendency of subsequent changes of the optimum control parameters of a development unit is the same (for all four development units). By this, the processing time for calibration can be decreased and the developer amount to be consumed for calibration can be decreased.

According to the calibration control in FIG. 4, as initialization processing, the non-volatile memories of a plurality of development units installed in the development device are accessed, the specified development unit and the ordinary development units are detected, and the installation positions and the relational values between the one specified development unit and the three ordinary development units are stored in the non-volatile memory 116*a* in the control unit (S10). At this time, information on the residual amount of the developer of each development unit is also read and stored in the non-volatile memory 116*a* in correspondence with the installation position. In the non-volatile memory of the development unit, the ID information thereof, identification information on whether a unit is the specified development unit or an ordinary development unit, color information and residual amount information are stored in advance. The residual amount information is updated at a predetermined timing when the development unit is used and the developer is consumed. Also as the initialization processing, calibration by a patch pattern is executed for all the development units, and the optimum control parameters are determined respectively according to the respective calibration result. And the relational values between the control parameters of the specified development unit and the control parameters of the other development units are stored in the non-volatile memory 116*a* (S12).

FIG. 5 is a table showing an example of the data to be stored in the non-volatile memory 116*a* by the above mentioned initialization processing. Corresponding to the installation positions A, B, C and D of the development units, information on whether it is the specified development unit or not, control parameters CPA of the specified development unit with respect to the position A where the specified development unit is installed, and the relational values dB, dC and dD with the control parameters of the specified development unit, with respect to the positions B, C and D where the ordinary development units are installed, are stored. By these relational values of the control parameters, the control parameters of the ordinary development units become CPB=CPA+dB, CPC=CPA+dC and CPD=CPA+dD respectively. In this way, the relational values dB, dC and dD with the control parameter CPA of the specified development unit are maintained for the ordinary development units, and at a predetermined calibration timing, calibration by a patch pattern is executed only for the specified development unit, and the control parameter CPA is updated, and the control parameters of the other ordinary development units are decided by the updated control parameters and the relational values dB, dC and dD. This is based on the assumption that characteristics unique to the four development units change in time while maintaining a mutual relationship, and in the case of monochrome printing, printing quality does not deteriorate very much as with color printing, even if characteristics deviate somewhat among the development units.

In FIG. 4, when the initialization processing is executed and the information shown in FIG. 5 is stored in the non-volatile memory 116*a*, calibration is executed at the four calibration timings respectively. When power is turned ON (S14), calibration by a patch pattern is executed using the specified development unit (S16). In other words, a predetermined patch pattern is developed and formed on the photosensitive drum using the specified development unit, and by detecting the optical density thereof, optimum control parameters CPA, such as the exposure intensity and bias voltage for charging, are decided. And these control parameters are updated in the non-volatile memory in the engine controller. And calibration for development units other than the specified development unit is not performed. When power is turned ON, the control parameters are updated corresponding to ambient environmental changes, for example, so if calibration is performed only for the specified development unit, the control parameters can be decided for the other development units based on equivalent tendencies.

When the photosensitive drum 20 is replaced (S18), calibration by a patch pattern is executed using only the specified development unit, just like the case when power is turned ON (S20). This calibration step S20 is the same as the above mentioned step S16. When the photosensitive drum is replaced as well, the change in control parameters tends to be the same for the four development units.

As described above, calibration is performed not for all the development units but only for the specified development unit when power is turned ON and when the photosensitive drum is replaced, so the calibration step can be shortened, and developer for the calibration can be consumed only from the specified development unit. The specified development unit is not used for printing by the user, but is used only for calibration and test printing for maintenance, without the user bearing the cost of the specified development unit, so the cost for developer required of the user for purposes other than normal printing can be avoided.

When the development unit is replaced (S22), calibration by a patch pattern is executed for the replaced development unit (S24). Calibration is not performed for the other development units. And the control parameters of the replaced development unit are determined according to the calibration result, and the relational values dB, dC or dD to the control parameter of the specified development unit in memory are updated. In the case when development units are not installed in all the installation positions and a new development unit is installed at a position where a development unit is not installed, calibration is executed only for the newly installed development unit, just like the above case of replacement, and the relational values thereof are stored in a memory.

When the residual amount of the developer of any development unit becomes a predetermined threshold Vth or less (S26), calibration by a patch pattern is executed by the development unit of which the residual amount is decreased (S28). And calibration for other development units is not executed. A decrease in developer indirectly shows that the period when the developer in the development unit which is charged exceeded the predetermined time. If the charging of the development toner exceeds a predetermined time, the charge characteristics change, and the bias voltage required for development must be changed. So by using residual amount management of the developer of the development unit, calibration of this development unit must be executed at a timing when the residual amount thereof becomes a predetermined threshold or less. Based on this calibration result, the control parameters of the development unit are determined, and the relational values dB, dC or dD in FIG. 5 are updated.

In the above embodiment, the specified development unit is in dedicated use for such maintenance as calibration. However when the development unit is replaced or when the residual amount of the development unit is a predetermined threshold or less, calibration is performed using the development unit. This means that the developer, subject to user expense, is used for the calibration. So the amount of developer required for calibration may be counted and stored, so that printing is performed using the specified development unit within the limit of developer amount consumed for calibration, in the later ordinary printing. By this, all the developer required for calibration can be covered by the developer of the specified development unit.

FIG. 6 is a flow chart depicting the calibration control according to the second embodiment. Processing steps the same as FIG. 5 are denoted with the same processing numbers. In this example, at a predetermined calibration timing, such as when power is turned ON or when the exposure drum is replaced, calibration is performed not for the specified development unit but only for an arbitrary development unit. An arbitrary development unit is, for example, a development unit positioned at the development position, or a development unit which has been installed the longest time or a development unit of which the residual amount of developer is lowest at a predetermined calibration timing.

First the respective non-volatile memory is read for the installed development units as the initialization processing, and ID information, residual amount information, color information etc. are stored in the non-volatile memory 116*a* in the engine controller (S30). Then calibration by a patch pattern is executed for all the development units, and the respective optimum control parameters are decided based on the calibration result, and the control parameters of an arbitrary development unit and the relational values with arbitrary control parameters for the other development units are stored in a memory. For example, in FIG. 5, the development unit at the installation position A is used for the arbitrary development unit here. The other control parameters and the relational values thereof are the same as the above description.

And when power is turned ON (S14), calibration by a patch pattern is executed using only an arbitrary development unit at one of the installation positions A–D (S34). Calibration for the other development units is not performed. And based on this calibration result, the control parameters CPA of the arbitrary development unit and the relational values dB, dC and dD of the other development units are updated. In other words, the representative development unit to be the calibration target need not always be fixed, and the development unit at the development position may be used to decrease the time required for calibration, or a development unit of which the residual amount of developer is lowest may be used to consume developer sequentially from the oldest development unit.

When the photosensitive drum is replaced (S18) as well, calibration by a patch pattern is executed using only an arbitrary development unit (S36). This calibration step S36 is the same as step S34.

When the development unit is replaced (S22), and when the residual amount of the development unit is decreased (S26), calibration is executed only for the replaced development unit or for the development unit of which the residual amount is decreased, just like the first embodiment, and the control parameters or the relational values thereof are updated (S24, S28).

In the second embodiment as well, at a predetermined calibration timing, such as when power is turned ON or when the photosensitive drum is replaced, calibration is performed not for all the development units but for one representative development unit, and the relational values of the mutual control parameters are updated. By this, the calibration step is simplified, the time thereof is shortened, and developer is conserved.

Figure 7:
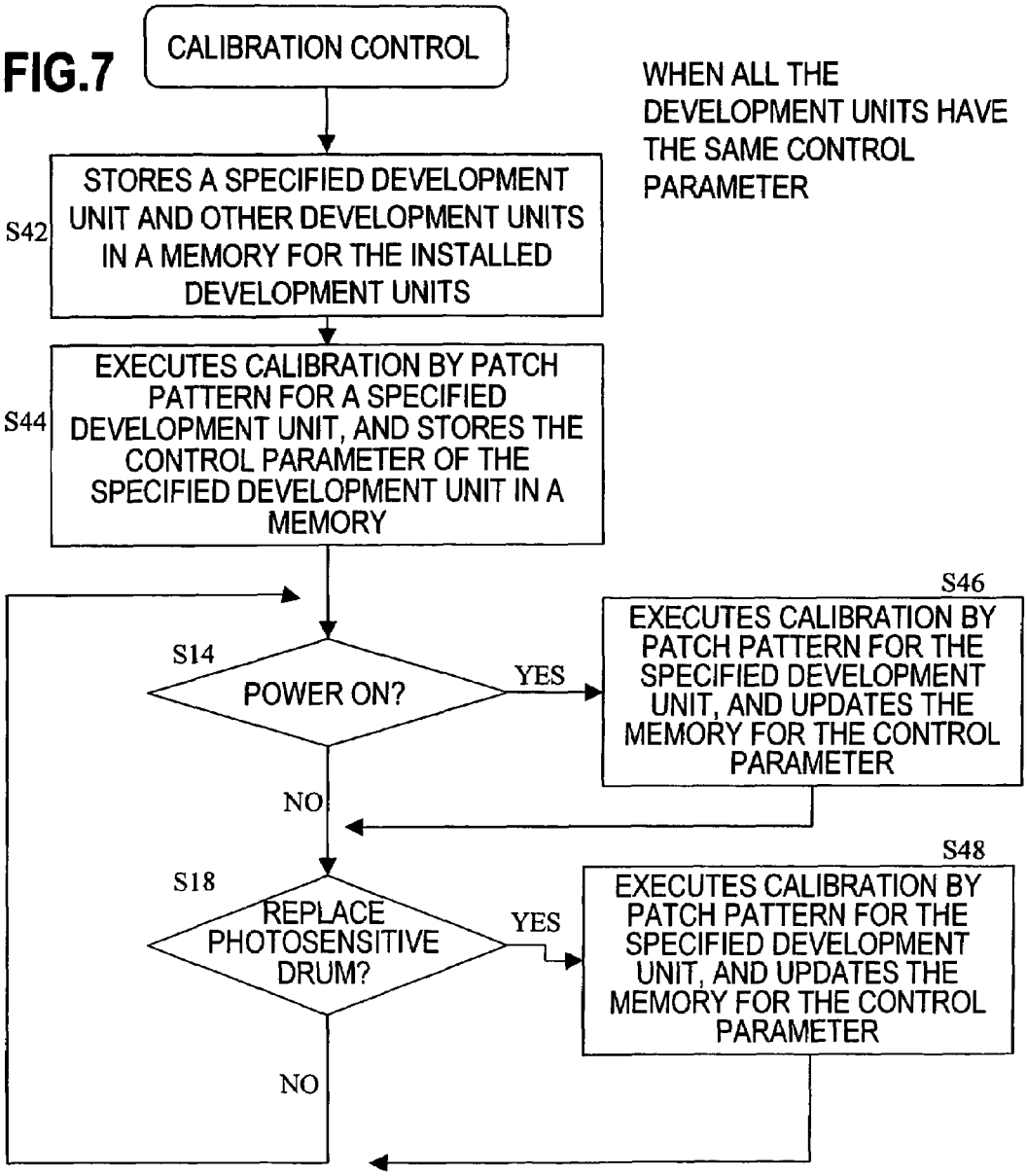
FIG. 7 is a flow chart depicting the calibration control according to the third embodiment.

FIG. 7 is a flow chart depicting the calibration control according to the third embodiment. In this embodiment, in the monochrome printing mode, common control parameters are used for all the development units assuming that the control parameters of all the development units are the same, and calibration is executed only for a specified development unit, and common control parameters are updated.

First as initialization processing, the information of the non-volatile memory of the installed development unit is read, and the relationship of the specified development unit and other development units and the installation positions thereof are stored in the memory (S42). Also as initialization processing, calibration by a patch pattern is executed for the specified development units, control parameters are determined based on the calibration result, and they are stored in a memory as common control parameters (S44). Since the control parameters of all the development units are used in common, calibration is performed only for a specified development unit, and calibration for the other development units is not performed in the initialization processing.

FIG. 8 is a table showing an example of the data to be stored in the non-volatile memory 116*a* by the initialization processing according to the third embodiment. The control parameters CPA determined for the specified development unit at the installation position A are stored as the control parameters for the other development units, and are used commonly.

In FIG. 7, when power is turned ON (S14), calibration is executed only for the specified development unit, and calibration is not executed for the other development units (S46). And based on this calibration result, the common control parameters CPA are updated. By this, the calibration step can be simplified. When the photosensitive drum is replaced (S18) as well, calibration is performed only for the specified development unit, and calibration is not performed for the other development units (S48). And based on this calibration result, the common control parameters CPA are updated. This step S48 is the same as step S46.

In the third embodiment, the control parameters are common for the four development units, so when an arbitrary development unit is replaced or newly installed, calibration is not executed for the replaced or newly installed development unit, but already updated common control parameters are used. When the residual amount of the developer of an arbitrary development unit becomes a predetermined threshold or less, common control parameters may be used continuously without executing calibration for this development unit. Or calibration may be executed for the development unit, and the control parameters may be updated to control parameters which are different from the common control parameters only for this development unit. In other words, common control parameters are used initially for the development units for exposure and development, and unique control parameters may be used for older development units for exposure and development.

In the third embodiment, calibration is performed using a specified development unit, so by not using the specified development unit for normal printing by the user, developer consumption for calibration need not burden the user. In the third embodiment, calibration may be performed not for the specified development unit but for an arbitrary unit to update the common control parameters. An arbitrary development unit is, for example, a development unit at the development position, or the oldest development unit.

In the above embodiments, a development unit comprises a non-volatile memory, and the specified development unit and the other ordinary development units are identified by reading information thereof, but the user may input information on the installation position of a development unit to be used as the specified development unit from the control panel without using the non-volatile memory. Or the installation position of the specified development unit may be fixed.

As described above, according to the present embodiment, the calibration step of the control parameters by a patch pattern formed using the development unit can be simplified, and the developer to be used can be decreased.

What is claimed is:

1. An image forming device, comprising:

an image carrier on which a latent image is formed;

a development device to which a plurality of development units for containing developer with the same color are detachably installed; and a control unit for forming a latent image on said image carrier based on a control parameter corresponding to said development unit and for developing said latent image by attaching the developer of said development unit thereto, wherein said control unit includes a calibration control unit for forming a latent image of a predetermined patch pattern on said image carrier at a predetermined calibration timing, developing said latent image by the developer of said development unit, detecting said developed patch pattern, and deciding said control parameter, wherein said calibration control unit stores a relationship of control parameters for said plurality of development units in a memory, wherein at said predetermined calibration timing, which comprises a timing when power is turned ON or a timing when said image carrier is replaced, said calibration control unit executes a first calibration by using only one arbitrary or one specific development unit out of said plurality of development units, and determines the control parameter for each unit based on said first calibration result and said relationship of the control parameters stored in said memory, and wherein, when said development unit is replaced or when the residual amount of developer of said development unit becomes a predetermined amount or less, said calibration control unit executes a second calibration by using said replaced development unit or by using said development unit of which the residual amount becomes said predetermined amount or less, and updates the relationship of the control parameters stored in said memory according to said second calibration result.

2. The image forming device according to claim 1, wherein said calibration control unit performs the first calibration by using only the one arbitrary development unit out of said plurality of development units at said predetermined calibration timing.

3. The image forming device according to claim 1, wherein said calibration control unit performs the first calibration by using only the one specific development unit out of said plurality of development units at said predetermined calibration timing.

4. The image forming device according to claim 1, wherein said calibration control unit performs the first calibration by only the one specific development unit, and wherein the one specific development unit is not employed during any normal print process.

5. An image forming device, comprising:

an image carrier on which a latent image is formed;

a development device to which a plurality of development units for containing developer with the same color are detachably installed; and a control unit for forming a latent image on said image carrier based on a control parameter corresponding to said development unit and for developing said latent image by attaching the developer of said development unit thereto, wherein said control unit includes a calibration control unit for forming a latent image of a predetermined patch pattern on said image carrier at a predetermined calibration timing, developing said latent image by the developer of said development unit, detecting said developed patch pattern, and deciding said control parameter, wherein said calibration control unit stores a relationship of control parameters for said plurality of development units in a memory, wherein at said predetermined calibration timing, which comprises a timing when power is turned ON or a timing when said image carrier is replaced, said calibration control unit executes a first calibration by using only one specific development unit out of said plurality of development units, and determines the control parameter for each development unit based on said first calibration result and said relationship of the control parameters stored in said memory, wherein, when said development unit is replaced or when the residual amount of the developer of said development unit becomes a predetermined amount or less, said calibration control unit executes a second calibration by using said replaced development unit or by using said development unit of which the residual amount becomes said predetermined amount or less, and updates the relationship of the control parameters stored in said memory according to said second calibration result, and said control unit controls development, at normal printing, using said specific development unit at least within the limit of the amount of developer consumed in said second calibration.

6. An image forming device, comprising:

an image carrier on which a latent image is formed;

a development device to which a plurality of development units for containing developer are detachably installed; and a control unit for forming a latent image on said image carrier based on the control parameter corresponding to said development unit and developing said latent image by attaching the developer of said development unit thereto, wherein said control unit includes calibration control unit for forming a latent image of a predetermined patch pattern on said image carrier at a predetermined calibration timing, developing said latent image by the developer of said development unit, detecting said developed patch pattern, and deciding said control parameters, and at said predetermined calibration timing, said calibration control unit performs calibration by all of said plurality of development units in a color printing mode in which development units with a plurality of colors are installed, and performs calibration by a part of said plurality of development units in a monochrome printing mode in which a plurality of development units with the same color are installed.

* * * * *